US006727499B2

(12) United States Patent
Zimmermann et al.

(10) Patent No.: US 6,727,499 B2
(45) Date of Patent: Apr. 27, 2004

(54) METHOD AND DEVICE FOR DETECTING COMPOUNDS IN A GAS STREAM

(75) Inventors: Ralf Zimmermann, München (DE); Jorg Heger, München (DE); Antonius Kettrup, Arnsberg (DE); Fabian Mühlberger, Kranzberg (DE); Klaus Hafner, Seeon (DE); Ulrich Boesl, Landshut (DE)

(73) Assignee: GSF-Forschungszentrum für Umwelt und Gesundheit GmbH, Oberschleissheim (DE)

( * ) Notice: Subject to any disclaimer, the term of this patent is extended or adjusted under 35 U.S.C. 154(b) by 89 days.

(21) Appl. No.: 10/243,536

(22) Filed: Sep. 14, 2002

(65) Prior Publication Data

US 2003/0020014 A1 Jan. 30, 2003

Related U.S. Application Data

(63) Continuation-in-part of application No. PCT/EP01/00848, filed on Jan. 26, 2001.

(30) Foreign Application Priority Data

Mar. 24, 2000 (DE) ..... 100 14 847

(51) Int. Cl.[7] ..... H01J 49/04; H01J 47/02

(52) U.S. Cl. ..... 250/288; 290/281; 290/282; 290/423 R; 290/423 P

(58) Field of Search ..... 250/288, 281, 250/282, 423 R, 423 P

(56) References Cited

U.S. PATENT DOCUMENTS 5,663,561 A * 9/1997 Franzen et al. ..... 250/288

FOREIGN PATENT DOCUMENTS

EP 0 685 487 3/1994

OTHER PUBLICATIONS

Gonthlez et al., "VUV Laser Photoionization of Laser–Stimulated Desorbed Species", Laser Ablation, Fifth international conference, Cola'99, Gottingen, Germany Jul. 19–23, 1999, vol. A69, pp. 171–173.

Rohlfing, "Resonantly Enhanced Multiphoton Ionization for the Trace Detection of Chlorinated Aromatics", Symposium (International) on Combustion, Combustion Institute, PGH, PA, USA, Aug. 14, 1988, pp. 1843–1850.

* cited by examiner

*Primary Examiner*—Nikita Wells
(74) *Attorney, Agent, or Firm*—Klaus J. Bach

(57) ABSTRACT

In a method and apparatus for detecting compounds in a gas stream, the gas stream with the compounds to be detected is conducted into an ionization chamber of a mass spectrometer where the gas stream is subjected in the ion chamber in a pulsed manner alternately to UV laser pulses and to vacuum ultraviolet VUV laser pulses and the ions generated thereby are directed into the mass spectrometer for detection therein to determine the compounds in the gas stream.

10 Claims, 3 Drawing Sheets

METHOD AND DEVICE FOR DETECTING COMPOUNDS IN A GAS STREAM

This is a continuation-in-part application of international application PCT/EP01/00848 filed Jan. 26, 2001 and claiming the priority of German application 100 14 847.6 filed Mar. 24, 2000.

BACKGROUND OF THE INVENTION

The invention relates to a method and device for detecting compounds in a gas stream, wherein the gas stream is irradiated in an ionization chamber of a mass spectrometer by an UV laser pulse and the ions generated thereby are detected in the mass spectrometer.

1. State of the Art

The resonance-enhanced multi-photon ionization (REMPI) technique, which utilizes UV-laser pulses for a selective ionization of for example aromatics, is used as a selective and soft ionization method for the mass spectrometry. The selectivity is determined among others by the UV spectroscopic properties and the location of the ionization potentials. A typical application is the on-line detection of aromatic compounds in exhaust gases[1]. It is a disadvantage of the REMPI method that it is limited to several substance classes and that the ionization cross-section may sometimes be very different for similar compounds.

The single photon ionization—(SPI) with VUV laser light permits a partially selective and soft ionization[2].

The selectivity is determined by the location of the ionization potentials. A typical application is the detection of compounds, which cannot be detected by REMPI. A disadvantage with the SPI method however is that some substance classes cannot be detected. Furthermore, the selectivity is smaller than with the REMPI method so that, with complex samples, interferences can be strong.

The electron impulse ionization (EI) using an electron beam is the standard technique for the ionization in the mass spectrometry of volatile organic and inorganic compounds. It is very universal (that is, not selective) and, with many molecules, results in a high fragmentation. However, it is highly suitable for a direct detection of compounds such as $O_2$, $N_2$, $CO_2$, $C_2H_2$, etc, which cannot be well detected by VUV or REMPI.

2. Object of the Invention

It is the object of the invention to provide a method and a device of the type referred to above with which however a multitude of compounds in the gas to be analyzed can be detected almost at the same time.

SUMMARY OF THE INVENTION

In a method and apparatus for detecting compounds in a gas stream, the gas stream with the compounds to be detected is conducted into an ionization chamber of a mass spectrometer where the gas stream is subjected in the ion chamber in a pulsed manner alternately to UV laser pulses and to vacuum ultraviolet VUV laser pulses and the ions generated thereby are directed into the mass spectrometer for detection therein to determine the compounds in the gas stream.

The combination of SPI and REMPI ionization performed in a mass spectrometer (quasi) simultaneously has a number of advantages. Both methods detect different partial amounts of the complex analysis gases with a different selectivity. In this way, altogether, more compounds of a sample can be identified.

If also the EI-ionization technique is utilized, additional compounds such as $CO_2$, $H_2O$ or $Ch_4$ can be detected, which cannot reasonably be detected with SPI or with REMPI. The combination of the methods and the device for the quasi-parallel use of the methods in a single apparatus results in the construction of particularly compact analytical MS-systems for example for online analytical field surveillance (process analysis), which have a very high performance. The REMPI—and/or VUV—and/or EI mass spectrometric data obtained in a parallel process may also be supplied to a chemometric analysis by way of sample recognition procedures (for example, a main component analysis).

Below, the invention will be described on the basis of examples with reference to the drawings.

DESCRIPTION OF A PREFERRED EMBODIMENT

Figure 1:
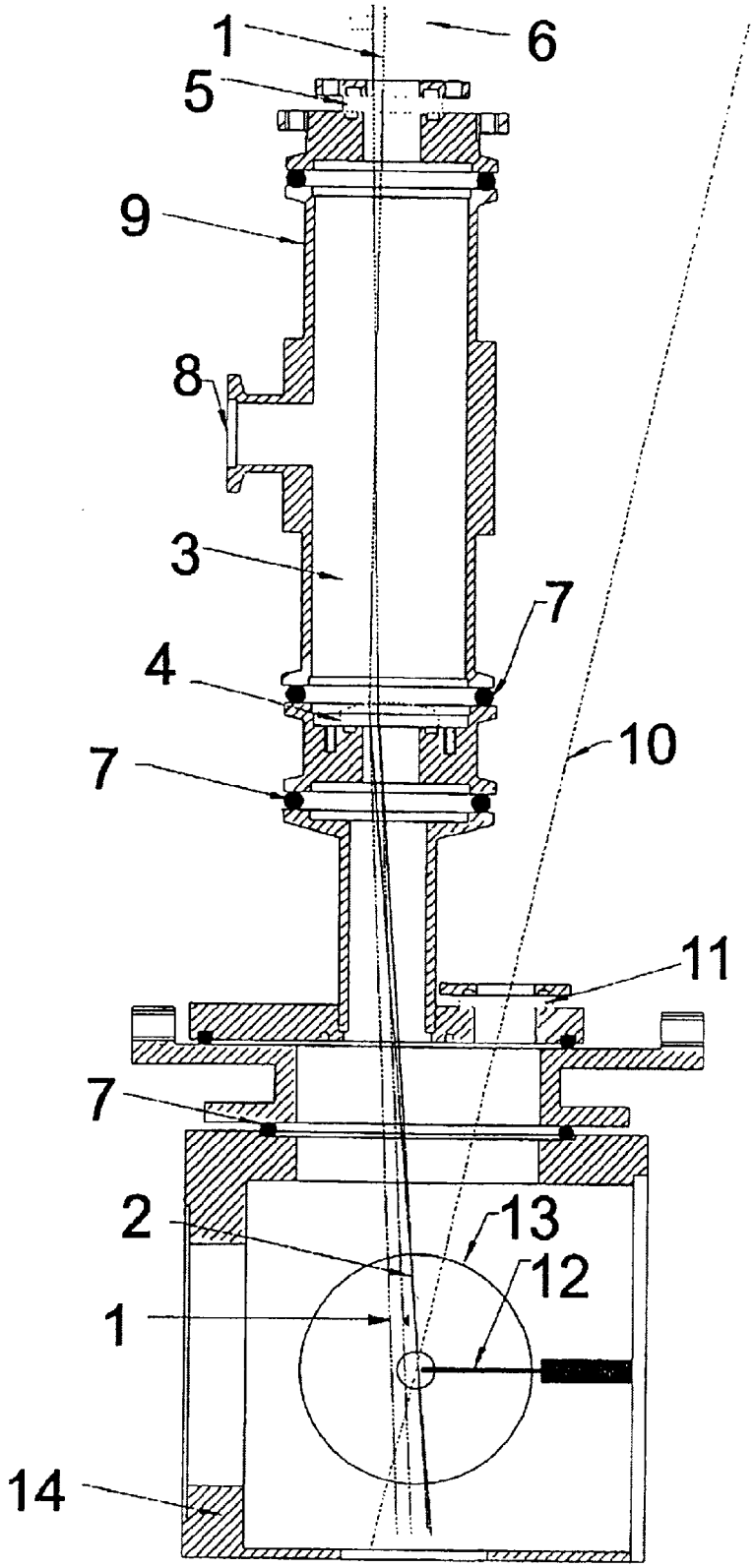
FIG. 1 is an exemplary view of the ionization region of the mass spectrometer 14 and of the gas chamber 9.

The (quasi-) parallel utilization of ionization with REMPI and SPI makes the concurrent examination of complex chemical samples possible. Because of the different selectivity of the two methods, different mass spectra are obtained with the respective methods. FIG. 1 shows the ionization region of the time of flight (TOF) mass spectrometers. The gas stream to be analyzed flows effusively through the inlet needle 12 into the ionization chamber 14[1]. Alternatively, also supersonic molecular beam inlet systems (described for example in [3]) may be employed. Analytes from the gas stream are irradiated directly below the inlet needle 12 alternately by UV laser pulses (266 nm) 10 and VUV laser pulses (118 nm) 2. The laser pulse length can be between 1 fs and 100 ns. The ions generated by multi-photon ionization are drawn through the opening of the withdrawal diaphragm 13 into the TOF-mass spectrometer and are mass-analyzed therein. Alternative to the alternating switching between UV laser pulses (266 nm) and VUV-laser pulses (118 nm) several pulses of one wavelength can be beamed in in series, before a switchover to the other wavelength. The VUV-laser beams (118 nm) 2 are generated in the gas chamber 9, which is filled with a noble gas (Xe and Ar) 3 by tripling of the frequency of 355 nm laser pulses 1. The 355 nm laser pulses 1 are focussed by a quartz lens 6 and directed through a quartz window 5 into the gas chamber 9. The VUV radiation formed thereby and the remaining 355 nm radiation 1 pass through the $MgF_2$ lens 4 into the ionization chamber 14 of the TOF mass spectrometer. The beaming in of the 355 nm laser beam 1 so that it is displaced with respect to the center of the $MgF_2$ lens 4 results in a spatial separation of the 355 nm laser beam 1 and the 118 nm beam in the ionization chamber. With a diaphragm, the 355 nm radiation can be captured ahead of the ionization location. This results in SP1 mass spectra, which are depleted of fragments.

Figure 2:
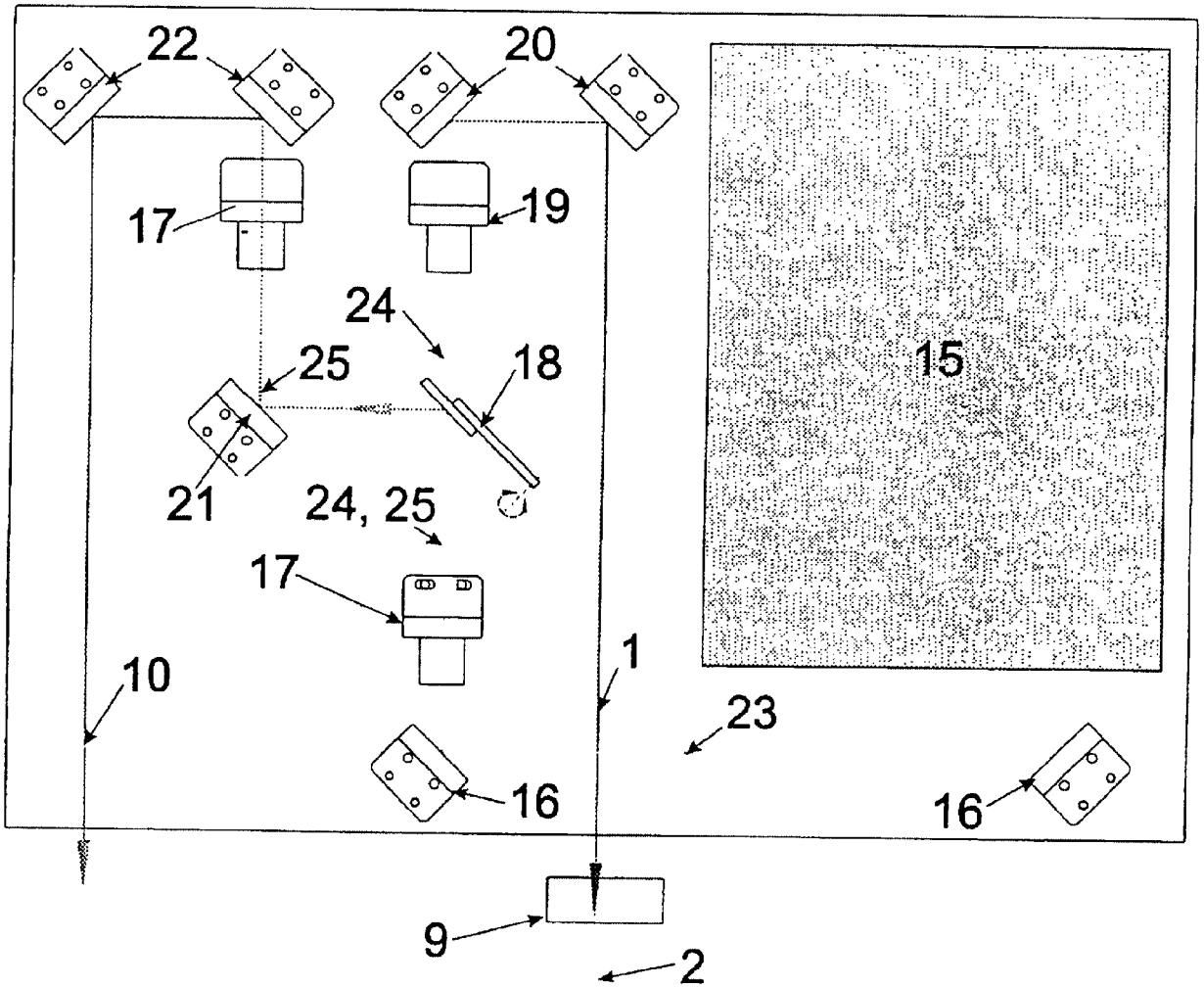
FIG. 2 shows schematically an optical arrangement for generating a UV-laser pulse 10 and a VUV laser pulse 2.

The alternate generation of the 266 nm and 118 nm 1 ionization pulses is achieved by a special optical arrangement as shown in FIG. 2. An Nd:YAG laser 15 generates a 1064 nm laser beam 23, which is conducted by way of two di-chroid mirrors 16 through a frequency doubling crystal 17. The resulting laser beam consists of 1064 nm and 532 nm laser radiation 24 and 25. A di-chroid mirror supported movably on an arm 18 so that it can be pivoted, by way of a galvanometer under the control of a computer, rapidly and precisely into the beam path is used to alternately permit passage of the laser beam and to deflect the laser beam. When the mirror arm 18 is pivoted out of the laser beam path, the laser beam 24 passes through a summing differential mixed crystal 19, whereby 355 nm laser light 1 is generated, which is separated by the di-chroid mirrors 20 from the co-linear 532 nm and 1064 nm radiation and is directed into the gas chamber 9 for generating the 118 nm VUV laser beam 2. When the mirror arm 18 extends into the laser beam, the 532 nm component of the beam 24 is diverted and deflected by the di-chroid mirror 21 to a doubling crystal 17. The resulting 266 nm laser beam 10 is separated by the di-chroid mirrors 22 from the 532 nm radiation and is used for the REMPI ionization in the inlet chamber 14 of the TOF mass spectrometer.

The data recording system records the REMPI and VUV-SPI mass spectra separately. If a sufficiently strong YAG laser is used, a partially permeable mirror (di-chroid radiation divider) can be used in place of a pivotable mirror. The masking out of the beam part, which is not needed, can be realized by way of a Pockels cell or a chopper wheel. Besides the Nd:YAG laser also other solid body lasers which can be operated in a pulsed fashion such as Ti: sapphire laser can be used.

From the primary wave of the Nd:YAG laser (1064 nm), the following harmonic frequencies can be generated: 523 nm (doubled), 355 nm, (tripled), 266 nm (quadrupled), 213 nm (quintupled) and 118 nm (nine-fold). In an extension of the two-beam process described above (266 nm for REMPI and 118 nm for VUV) also several wavelengths can be introduced in an alternating fashion. With a combination of 266, 213 and 118 nm are for example simultaneously (that is, slightly displaced) two different REMPI selectivities utilized, in addition to the VUV selectivity. For example, napthalene and its methylized derivatives (these compounds are indicators for the efficiency of combustion processes) can be detected particularly efficiently with 213 nm. Consequently, depending on the solid body laser type, 2, 3 or more wavelengths can be used in parallel with the ionization of compounds from the sample. The different selectivities, which are induced by the different REMPI and/or VUV wavelengths, result in respective different mass spectra (that is, respective other compounds appear or disappear from the mass-spectrum). If, with highly complex samples or unknown samples, the compounds detected cannot be assigned, chemometric procedures for the sample recognition (for example, main component analysis) and consequently, phenomenological characterization may be employed. With the use of non-adjustable frequency displacement units (for example by way of optical-acoustic coupling, with a Raman shifter with an optical-parametric-oscillator crystal, with a color laser unit) a frequency may be converted to a desired frequency for a selective REMPI-detection of a particular compound. For example, a frequency can be tuned to a resonance of monochlorobenzene (for example, at about 266 nm or at about 269.82 nm[4]). Monochlorobenzene is an indicator for the presence of toxic polychlorinated dibenzo-p-dioxins and -furans (PCDD/F) and can be detected by REMPI on line in the exhaust gases of for example technical combustion processes 5). With a wavelength of about 269.82 nm a detection of monochlorobenzene (MCB) as well as a number of other aromatics such as benzene, napthalene or pyrene is possible. Alternatively, MCB can be detected at a resonance very close to the quadrupled Nd:YAG wavelength[4]). To this end, it may be sufficient in certain cases to slightly de-tune the base wave of the Nd:YAG laser for example by a manipulation of the laser resonator.

Then, parallel compounds such as $NH_3$, NO, many aldehydes and ketones etc, which can not be detected with REMPI at the MCB resonance, can be detected.

An analytical laser mass spectrometer may further advantageously be equipped with an inlet system for the generation of a supersonic molecular beam (jet). The adiabatic cooling achieved thereby increases the selectivity of the REMPI-TOFMS method[6] and decreases the fragmentation with SPI and EI-ionization.

The EI ionization achieves only much smaller effective cross-sections than the laser ionization (with the common pulse energies); however, the repetition rate of the laser impulse processes, which operate in a pulsed fashion, is limited in many compact laser systems to 10–20 Hz. Since the recording of a mass spectrum takes, after the ionization pulse, only several 10 $\mu$s, the mass spectrometer is not utilized most of the time.

The EI ionization uses an electron cannon, which accelerates electrons with kinetic energies of 2–200 eV toward the sample molecules. By way of pulsed electron cannons and pulsed withdrawal fields the normally continuously operating EI-method can be used also with the flight time mass spectrometry. This is possible also parallel with the use of the laser ionization methods (REMPI, SPI). Typically the information of the laser ionization methods is recorded by means of a transient recorder, whereas the information from the EI-ionization is recorded by way of counting cards. The inclusion of the electron impulse ionization permits the direct on-line measurement of the compounds present in higher concentrations, which cannot be detected by REMPI or SPI.

Application Examples

The method described above and the apparatus can be used in principle for a multitude of applications. Below, four application examples are presented:

Application Example 1

Surveillance of Combustion Processes

Figure 3:
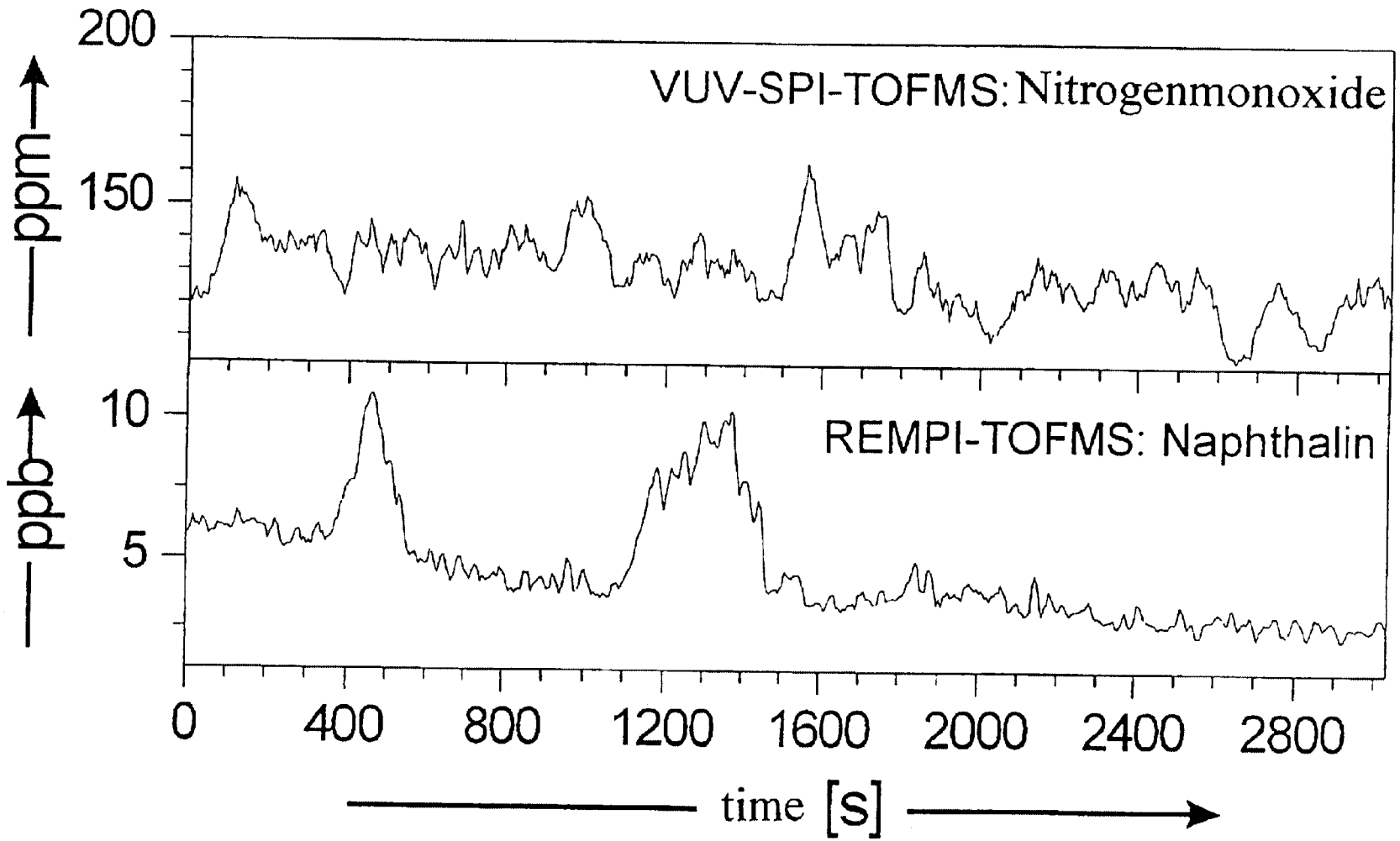
FIG. 3 shows an online measurement of NO and napthalene in the exhaust gas of a waste combustion plant taken with alternating SPI ionization (VUV for NO) and REMPI-ionization (UV for napthalene).

REMPI has evolved as a very powerful analytical method for the online analysis of aromatic hydrocarbons, dioxin-indicators (MCB) and other compounds [1]. Obtaining at the same time information for example concerning nitrogen compounds such as NO, $NH_3$ or the aldehydes would be important. These compounds can be detected with VUV. Consequently, the VUV-SPI and REMPI ionization methods complement each other and can be used together advantageously for a good characterization of the combustion process. If the parallel EI ionization is implemented, a comprehensive characterization is achieved since several chemical main parameters, such as concentrations of $CO_2$, $O_2$ and smaller organic molecules such as acetylene (important for the formation of polycyclic aromatics and carbon aerosols) cannot be detected with the usual SPI VUV wavelengths or with 2 photon-REMPI processes. The method with a corresponding apparatus is suitable for characterizing and analyzing all kinds of combustion and pryolysis processes. FIG. 3 shows the concentration of napthalene and NO in the exhaust gas of a garbage combustion plant (raw gas at 700° C.) recorded with parallel VUV-SPI and REMPI ionization.

Application Example 2

Online Analysis of Process Gases in the Food Stuff Technology

In the surveillance of food technological processes (drying processes, roasting or ripening processes etc.) and also in the quality control of raw materials (fungal infestations, quality) or the evaluation of the sensoric quality, online mass spectrometric processes can be used. Initial experiences were already made with the REMPI method in the field of coffee roasting [7]. With REMPI (266 nm), the degree of roasting can be determined by the composition of differently substituted components. Many aroma-relevant compounds (aliphatic aldehydes and ketones, furan derivatives, nitrogen heterozyclen, etc.), however can be detected well with VUV ionization. The electron impulse ionization permits the tracing of the primary coffee roasting products $CO_2$ and $H_2O$. In principle, a multitude of such processes can be comprehensively controlled and validated with the method and apparatus of this type.

Application Example 3

Online Analysis of Headspace Samples of Complex Mixtures

The method can be employed with an apparatus of the type described for the analysis of complex substance mixtures (solid materials, solution/liquid, gas phase). Suitable auxiliary apparatus (head space sampling, thermo-desorber, etc.) can be used for obtaining a representative gas sample. For example, process solutions of the chemical industry, mineral oil products and also end products such as perfumes or deodorants can be analyzed and surveilled.

Application Example 4

On-line Analysis of Medically Relevant Samples

With an apparatus of the type described, the method can be used by patients and control persons for the analysis of the breath (exhaled). Certain volatile compounds such as acetone are an indication of illnesses or of the general state of health. Furthermore, the gas space (head space) above medical samples (blood, urine etc., can be analyzed.

REFERENCES (1) Heger, H. J.; Zimmermann, R.; Dorfner, R.; Beckmann, M., Griebel, H.; Kettrup, A.; Boesl, U. *Anal. Chem.* 1999, 71, 46–57.

(2) Butcher, D. J.; Goeringer, D. E.; Hurst, G. B. *Anal. Chem.* 1999, 71, 489–496.

(3) Rohlfing, E. A. In *22nd Symposium (International) on Combustion*; The Combustion Institute: Pittsburgh, 1988, pp 1843–1850.

(4) Heger, H. J.; Boesl, U.; Zimmermann, R.; Dorfner, R.; Kettrup, A. *Eur. Mass Spectrom.* 1999, 5, 51–57.

(5) Zimmermann, R.; Heger, H. J.; Blumenstock, M.; Dorfner, R.; Schramm, K. -W.; Boesl, U.; Kettrup, A. *Rapid Comm. Mass. Spectrom.* 1999, 13, 307–314.

(6) Tembreull, R.; Lubman, D. M. *Anal. Chem.* 1984, 56, 1962–1967.

(7) Zimmermann, R.; Heger, H. J.; Yeretzian, C.; Nagel, H.; Boesl, U. *Rapid Comm. Mass. Spectrom.* 1996, 10, 1975–1979.

What is claimed is:

1. Method for detecting compounds in a gas stream by a mass spectrometer including an ionization chamber, said method comprising the steps of:

a) conducting the gas stream with the compounds into the ionization chamber of the mass spectrometer, b) irradiating the gas stream in the ionization chamber by an UV-laser pulse and c) detecting the ions generated thereby in the mass spectrometer, and d) alternately exposing the gas stream in the ionization chamber, in uniform or non-uniform intervals, to vacuum ultraviolet (VUV) laser pulses and to UV-laser pulses, and detecting and analyzing the ions generated thereby in the mass spectrometer.

2. A method according to claim 1, wherein the UV laser pulse and the VUV laser pulse are generated by means of a solid body laser.

3. A method according to claim 1, wherein the UV laser pulse is generated from the solid body laser pulse by at least one of frequency mixing and frequency multiplication.

4. A method according to claim 3, wherein the UV laser pulse is tuned by the use of one of a color laser and an optical parametric oscillator.

5. A method according to claims 1, wherein the VUV laser pulse is generated from the solid body laser pulse by at least one of frequency mixing and frequency doubling with a subsequent frequency tripling in a gas chamber.

6. A method according to claim 1, wherein the wavelength of the VUV laser pulse is tuned by the use of one of a color laser and an optical parametric oscillator ahead of the frequency tripling in the gas cell.

7. A method according to claims to 6, wherein, in the time period between the VUV laser pulses, the gas stream is irradiated in the ionization chamber by an electron beam for electron impulse ionization and the ions generated thereby are detected in the mass spectrometer.

8. An apparatus for the detection of compounds in a gas stream, consisting of a) a mass spectrometer including an ion source with an ionization chamber and having a gas inlet leading to the ionization chamber of the ion source of the mass spectrometer, b) a solid body laser with optical elements for the mixing and/or multiplication of a base frequency of the solid body laser, wherein from the base frequency a UV laser pulse can be generated and introduced into an area of the ionization chamber ahead of the gas inlet, c) a data recording and processing system for the mass spectrometer, and d) an optical component for dividing the laser pulse into two partial beams, wherein from one of the partial beams the laser pulse is generated with the aid of additional optical elements and is directed into the ionization chamber in the area ahead of the gas inlet, and e) additional optical components and a gas chamber with a suitable gas flow wherein from the frequency-doubled and guided other partial beam in the gas chamber a VUV laser pulse is generated by frequency tripling and directed into the area of the ionization chamber ahead of the gas inlet, and f) alternately exposing the gas stream in the ionization chamber, in uniform or non-uniform intervals, to vacuum ultraviolet (VUV) laser pulses and to UV-laser pulses, and detecting and analyzing the ions generated thereby in the mass spectrometer.

9. An apparatus according to claim 8, wherein one of a color laser and an optical parametric oscillator is provided in at least one of the beam paths.

10. An apparatus according to claim 8, wherein an electron cannon is provided, which can be pulsed for the electron impulse ionization of the compounds in the gas beam ahead of the gas inlet in the ionization chamber of the mass spectrometer.

* * * * *